US008593276B2

(12) United States Patent
Doyle

(10) Patent No.: US 8,593,276 B2
(45) Date of Patent: Nov. 26, 2013

(54) METHOD AND APPARATUS FOR ASSET GEOFENCING

(75) Inventor: Thomas F. Doyle, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 154 days.

(21) Appl. No.: 11/346,495

(22) Filed: Feb. 1, 2006

(65) Prior Publication Data

US 2007/0176771 A1 Aug. 2, 2007

(51) Int. Cl.
*G08B 1/08* (2006.01)

(52) U.S. Cl.
USPC ..... 340/539.13; 340/539.11

(58) Field of Classification Search
USPC ..... 340/539.11, 426.11–426.22, 995.21, 340/573.1, 10.51, 572.8, 568, 539.13, 457, 340/10.1, 686.1
See application file for complete search history.

(56) References Cited

U.S. PATENT DOCUMENTS 7,164,986 B2 * 1/2007 Humphries et al. ..... 701/207
7,379,805 B2 5/2008 Olsen, III
2006/0015233 A1 * 1/2006 Olsen et al. ..... 701/50

OTHER PUBLICATIONS

International Search Report, PCT/US20071081472—International Search Authority—ISA/US—Nov. 3, 2008
Written Opinion, PCT/US2007/081472—International Search Authority—ISA/US—Nov. 3, 2008.

* cited by examiner

*Primary Examiner* — Shirley Lu
(74) *Attorney, Agent, or Firm* — Richard A. Bachand; Mary A. Fales

(57) ABSTRACT

An asset tracking unit associated with an asset determines that the asset is located at a site and establishes a geofence. The asset tracking unit transmits a notification to a central dispatch that the asset is at the site. In the event that the asset moves beyond the geofence boundary, a notification is sent to the central dispatch indicating that the asset has moved. The asset tracking unit established the geofence based on pre-established boundary criteria that are stored at the asset tracking unit.

26 Claims, 11 Drawing Sheets

METHOD AND APPARATUS FOR ASSET GEOFENCING

BACKGROUND

1. Field

This disclosure relates generally to asset tracking, and, more specifically, to monitoring asset movement and generation of notifications if an asset is moved from a particular site.

2. Background

Tracking the location and movement of assets can be a valuable undertaking for many companies. Assets of the company, in and of themselves, are often quite valuable and monitoring the location of such assets can be important to prevent theft or unauthorized use of the asset. For example, heavy construction equipment is commonly very valuable, with a single piece of equipment commonly worth in excess of one hundred thousand dollars. Furthermore, such equipment is frequently moved to new locations and used in construction activities. Such equipment is either owned by a particular construction company or leased from a leasing company. In either case, the owner of the equipment generally desires to have knowledge of the location of such equipment, and also to be notified if the equipment is moved away from a location.

The equipment owner may desire to have such knowledge to both ensure that the productivity of the equipment is maintained, and to be able to locate the asset in the case of an unauthorized use of the asset or theft of the asset. For example, if the equipment owner has leased the equipment to be used at a certain site, movement of the equipment away from that site may indicate that a thief is attempting to steal the equipment. Having the location of the equipment may thus help recover any stolen equipment, or stop a theft that is in progress. This ability helps to maintain the value of the company's asset portfolio and in many cases significantly reduces the cost of insurance for the company. Numerous other examples exist where it may be desired to track the location of assets.

In order to accomplish such asset tracking, assets are commonly equipped with a tracking unit that has a location sensor, such as a global positioning satellite (GPS) receiver, and is able to send location information of the asset to a central location. In this manner, an interested party may remotely monitor the location of the particular asset. Furthermore, some asset tracking systems may have a boundary established and generate an exception report in the event that the asset moves beyond such a boundary. Such a boundary is commonly referred to as a "geofence." When the asset moves beyond the geofence boundary, a notification is generated that may be acted upon to determine why the geofence boundary was crossed. Using the construction equipment example, a geofence boundary may be established that corresponds to a perimeter of the construction site. If a piece of equipment that is located at the particular construction site crosses the geofence boundary, a notification is generated to alert an appropriate person that the piece of equipment is no longer on the construction site.

As will be recognized, the setting of geofences, and monitoring of assets associated with the geofences can become a resource intensive task. For example, if an equipment leasing company has a large number of equipment assets that may all be leased at any given time and located at any of a number of different sites, establishing such geofences and monitoring the equipment locations can require significant resources.

SUMMARY

Methods and systems for monitoring assets and setting geofences in an efficient manner are disclosed. In one embodiment, a method is provided for establishing a geofence for an asset, the method comprising the steps of: (a) providing an asset tracking unit operably interconnected with an asset, the asset tracking unit comprising a location sensing component; (b) monitoring a location of the asset by the location sensing component; (c) determining that the asset is located at a site; and (d) setting a geofence having a predetermined boundary. The steps of monitoring, determining, and setting may be performed at the asset tracking unit or at a remote server that is in communication with the asset tracking unit. In another embodiment, the method further comprises the steps of: (e) determining that a location of the asset is outside of the geofence; and (f) transmitting a notification that the asset is outside of the geofence. When determining that the location of the asset is outside of the geofence, the determination may be made by determining that a location of the asset tracking unit is outside of the predetermined geofence boundary; and determining that a speed of the asset tracking unit is greater than a predetermined speed. The predetermined boundary of the geofence may be established based on an expected movement of the asset while the asset is located at a site. Such a boundary may be a default boundary associated with the asset, or may be a boundary that is established by a remote server. In another embodiment, the asset is determined to be located at a site by analyzing the rate of movement of the asset and determining that the asset is at the site when the rate of movement for a predetermined period of time meets established criteria. Such established criteria may be met when a speed of the asset is below a preset threshold for the predetermined time period. The criteria may also include monitoring the location of the asset and determining the asset is at a site when the location of the asset is within a predefined radius for a preset time.

In another embodiment, an asset tracking unit is provided that is operably coupled to an asset. The asset tracking unit comprising: (a) location sensor operable to output a current location; (b) a wireless communication portion operable to send/receive wireless communication; and (c) a controller operably coupled to the location sensor and wireless communication portion. The controller is operable to receive location information from the location sensor, use the location information to determine that the asset is located at a site, and establish a geofence when the asset is located at the site, the geofence having a predetermined first boundary. The controller, in an embodiment, is also operable to send a notification to a remote server using the wireless communication portion when the controller determines that the asset is located at the site. The controller is also operable, in an embodiment, to receive a response from the remote server and establish a second geofence with a different boundary when the response indicates such a second geofence is to be established. The controller is also operable, in an embodiment, to transmit a notification using the wireless communication portion to a remote server indicating the location of the asset is outside of the geofence when the location sensor provides a current location that is outside of the first boundary. The controller may transmit the notification based on a rate of movement of the asset, with such a transmission only being transmitted when the rate of movement is above a preset rate of movement. The controller may also transmit the notification when the asset location is outside of the boundary for a predefined period of time.

DETAILED DESCRIPTION

There is a need and desire of entities having a significant number of valuable assets to monitor the location of such assets and generate notifications of movement of such assets in a manner that is efficient to the entity. It is further recognized that a company is generally not interested in tracking the location of an asset while the asset is located at a particular site, but rather the movement of the asset from site to site, or when the asset leaves a site. Systems, methods, and apparatuses are disclosed to efficiently monitor such movement by providing an asset tracking device that is able to determine when the asset is at a site, generate a geofence for the site, and transmit a notification if the asset leaves the site. In such a manner, the company may consume significantly fewer resources when monitoring assets by reducing or eliminating the need to generate a geofence boundary for each asset being tracked. The term geofence, as used herein refers to a defined boundary that is associated with an asset. The asset tracking unit that is associated with the asset monitors the location (such as latitude and longitude coordinates) using a location sensor such as a GPS receiver. The location coordinates are compared to the defined boundary, and a notification is generated if the boundary is crossed.

Figure 1:
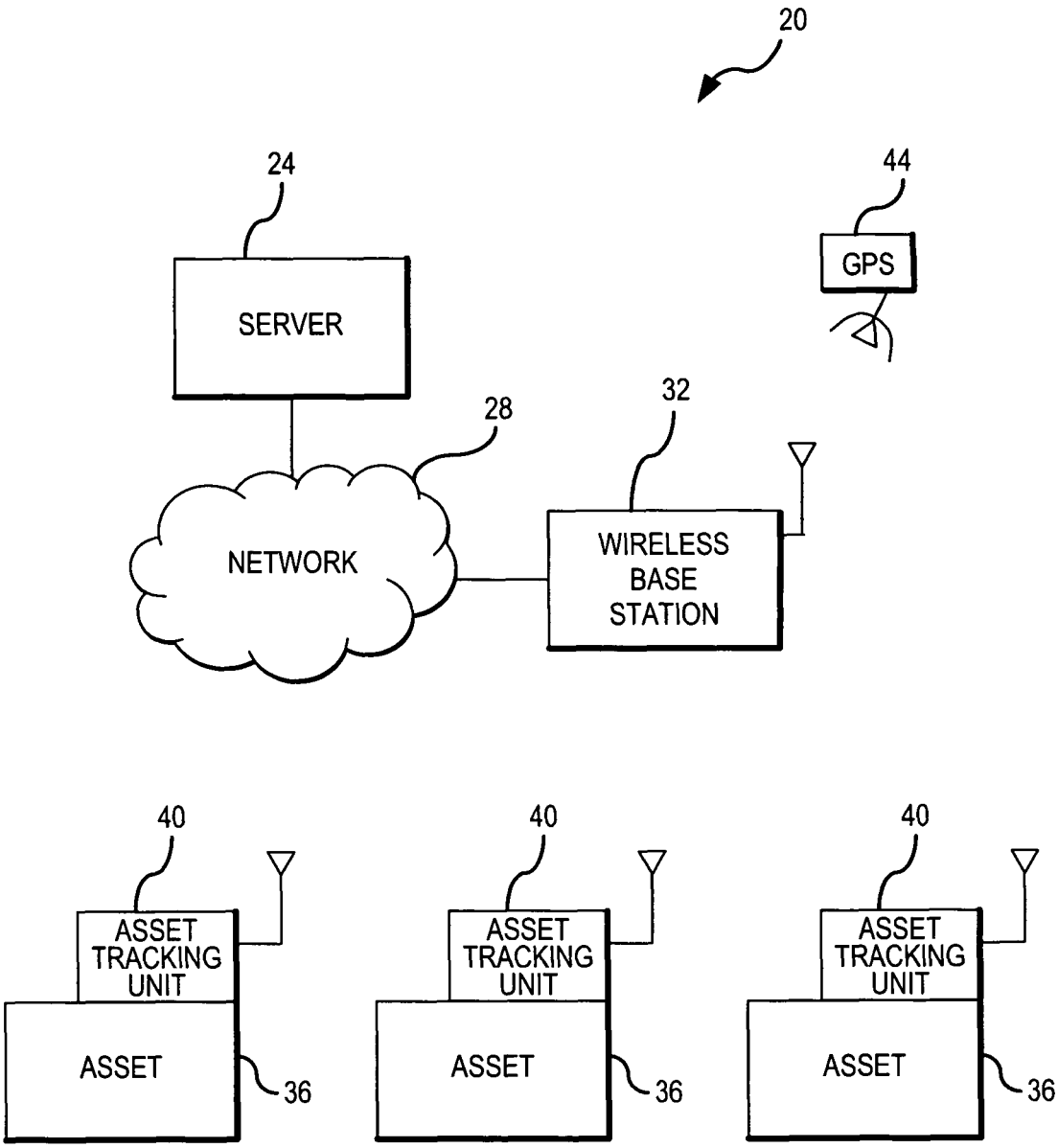
FIG. 1 is a block diagram illustration of an asset tracking system

FIG. 1 is a block diagram of an exemplary asset tracking network 20 of one embodiment. The asset tracking network 20 includes a server 24 which is interconnected to a network 28, which in one embodiment is a public switched telephone network (PSTN). The server 24 may reside in a dispatch center or a monitoring center for a company, or may be connected to a dispatch or monitoring center via another network (not shown) such as the Internet. The server 24, in one embodiment, receives communications from and sends communications, including various commands, through the network 28 and a wireless base station 32 to asset tracking units 40. As is common in the art, such asset tracking units 40 may include wireless communication components that are used to transmit location information to the server 24 through a wireless communication network. Such asset tracking units 40 are coupled to assets 36, and may include units that are affixed to the asset or that are built into the asset. Such assets 36 may include any type of asset, including, for example, vehicles, construction equipment, trailers, rail cars, computer equipment, valuable items, perishable items, and human assets (e.g. employees), to name but a few. The wireless base station 32 operates to provide wireless communications between the network 28 and asset tracking units 40. As will be understood, a wireless communication network will typically contain numerous wireless base stations 32. One such station 32 is included in the illustration of FIG. 1 for purposes of illustration and discussion, with the understanding that numerous such wireless base stations 32 may be present. The wireless base stations 32 and asset tracking units 40 may communicate using any applicable wireless communication scheme over a voice channel, data channel, and/or control channel. Communication may use any available analog and/or digital technology, including the various different types of digital communications, as well as combinations thereof. The asset tracking units 40 include position sensing receivers that are capable of providing the location of the asset tracking unit 40, and thus also provide the location of the associated asset 36. In this embodiment, the position sensing receivers include GPS receivers that receive signals from various GPS satellites 44. As is understood in the art, a GPS receiver operates to provide location information to a relatively high degree of accuracy by performing well known trilateration algorithms based on signals from several GPS satellites 44.

In one specific embodiment, the server 24 is located in a control and dispatch center of an equipment leasing or company having equipment leased to various different customers and located at various customer sites, each piece of equipment having one or more asset tracking units 40. A dispatch center may have server 24 that operates to monitor the locations of the various pieces of equipment. An employee, or automated system, of the dispatch center may note when various pieces of equipment are moving between sites, have arrived at a particular site, or are moved from a particular site. The server 24 may be connected by any appropriate connection to the network 28. As mentioned above the network 28 may be a PSTN that is in turn connected to the wireless base station 32. The server 24 may have a modem which connects to the network 28 to establish a connection to a particular asset tracking unit through the wireless base station 32. Each of the asset tracking units 40 has a unique identification that is associated with a particular asset 36 that the asset tracking unit is associated with. The server 24 and asset tracking units 40 may establish any type of communication to indicate that the location of the asset 36 provided by the asset tracking unit 40. In addition to monitoring location information and transmitting such information to the server 24, the asset tracking units 40 may also provide other functions, such as voice communications and data messaging. In one embodiment, the asset tracking units 40 monitor their location and make a determination that the asset 36 is located at a site by analyzing the location information. The asset tracking unit 40, when it is determined that the asset is at a site, establishes a geofence, and transmits a notification to the server 24 if the geofence is broken. The determination that an asset 36 is located at a site, the setting of a geofence, and the determination that the geofence has been broken are described in more detail below.

Figure 2:
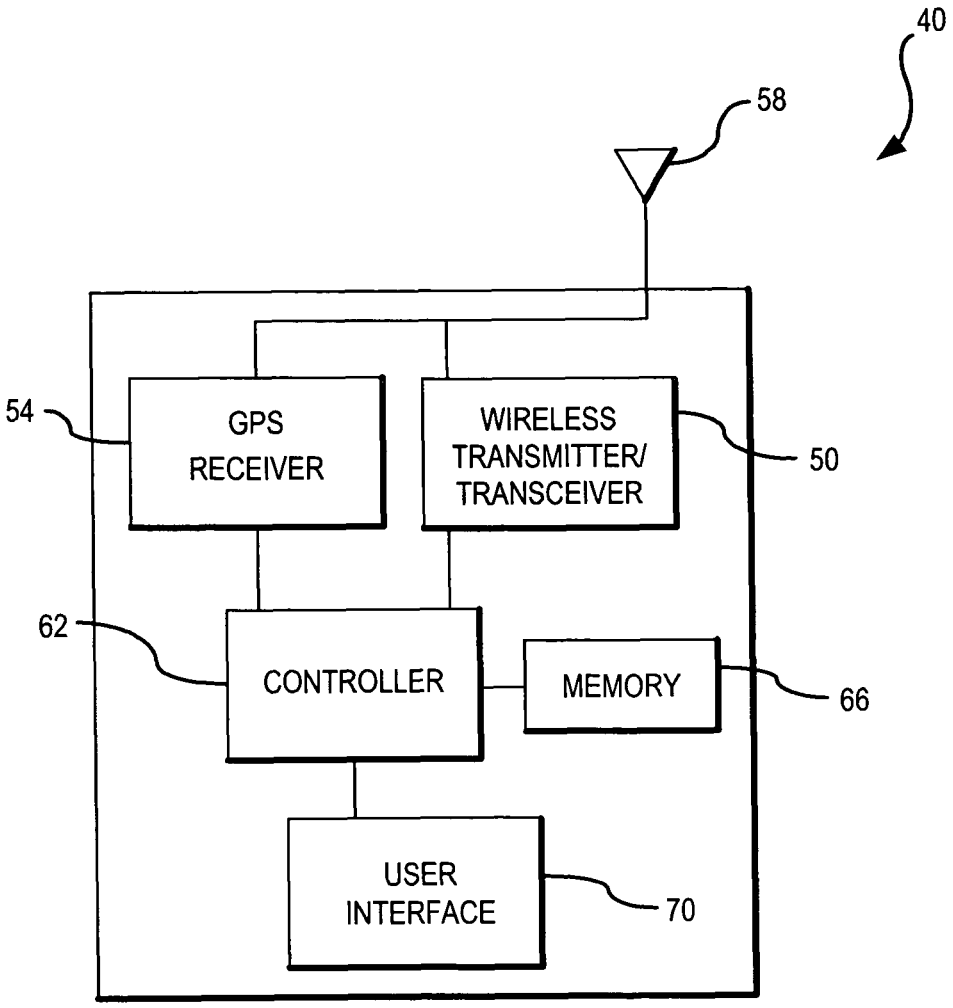
FIG. 2 is a block diagram illustration of an embodiment of an asset tracking unit.

Referring now to FIG. 2, an embodiment of an asset tracking unit 40 that includes circuitry and components that are typical of many such devices. The device includes a wireless transmitter/receiver 50, a GPS receiver 54 and an antenna 58. The wireless transmitter/receiver 50 is operable to receive wireless signals that are received at antenna 58 and demodulate the signals and provide them to a controller 62. The wireless transceiver 50 may also receive signals from the controller 62, modulate the signals onto an RF signal and transmit the modulated signal over the antenna 58. The GPS receiver 54 is operable to receive a GPS signal from an appropriate number of GPS satellites to determine location information. The GPS receiver 54 is also connected to antenna 58. Antenna 58, while illustrated as a single antenna, may include one or more separate antennas, such as a separate antenna for the GPS receiver, a send antenna, and/or a receive antenna. The controller 62 is coupled to a memory 66 and an optional user interface 70. The controller 62 controls operations of the asset tracking unit 40 including operating any applications that are running on the asset tracking unit 40. The memory 66 may include any type of memory suitable for such an asset tracking unit 40 including volatile and/or non-volatile memory. The memory 66 includes code to run the different applications for the asset tracking unit 40. For example, memory 66 may include a tangible data storage medium comprising executable data capable of causing a programmable device to perform the steps of monitoring a location of an asset, determining that the asset is located at a site, and setting a geofence having a predetermined boundary. In certain examples, a tangible data storage medium may further comprise executable data capable of causing the programmable device to perform the steps of determining that a location of the asset is outside of the geofence boundary, and transmitting a notification that the asset is outside of the geofence. In certain examples, determining that a location of the asset is outside of the geofence step may further comprise determining that a location of the asset is outside of the predetermined boundary, and determining that a speed of the asset is greater than a predetermined speed. In certain examples, a setting a geofence step may further comprise setting the geofence to a predetermined default boundary associated with the asset, transmitting a notification to a remote server that the geofence has been set, receiving a response from the remote server indicating a revised boundary for the geofence, and resetting the geofence to have a boundary corresponding to the revised boundary. The optional user interface 70 may be any appropriate user interface including a visual and/or graphical user interface and associated keypad and/or any other physical input device.

Referring now to FIGS. 3 through 7, the asset 36 and associated asset tracking unit 40 are generally illustrated in and around a site 100. The site 100 includes a site boundary 104 illustrated with cross-hatching. The site boundary 104 is the physical location of the edges of the particular site 100 that may be defined using, for example, latitude and longitude coordinates or coordinates of any appropriate datum such as WGS84. The coordinates of boundary 104 are, in many instances, known to a relatively high degree of accuracy. For example, the site 100 may be a construction site that will be subject to commercial, industrial, and/or residential development. In such a case, a survey may have been made of the site that identifies the site boundary 104 to a high degree of accuracy. When such boundary coordinates are available, they may be used to establish a geofence for an asset that is to be used at the site. While such coordinates may be used to provide a relatively accurate geofence boundary for a particular asset, programming such a geofence can be resource intensive. In many instances, asset location monitoring may be effectively accomplished using relatively rough estimates of the site boundary, and thus resources to program a precise geofence may not be needed in many cases.

Figure 3:
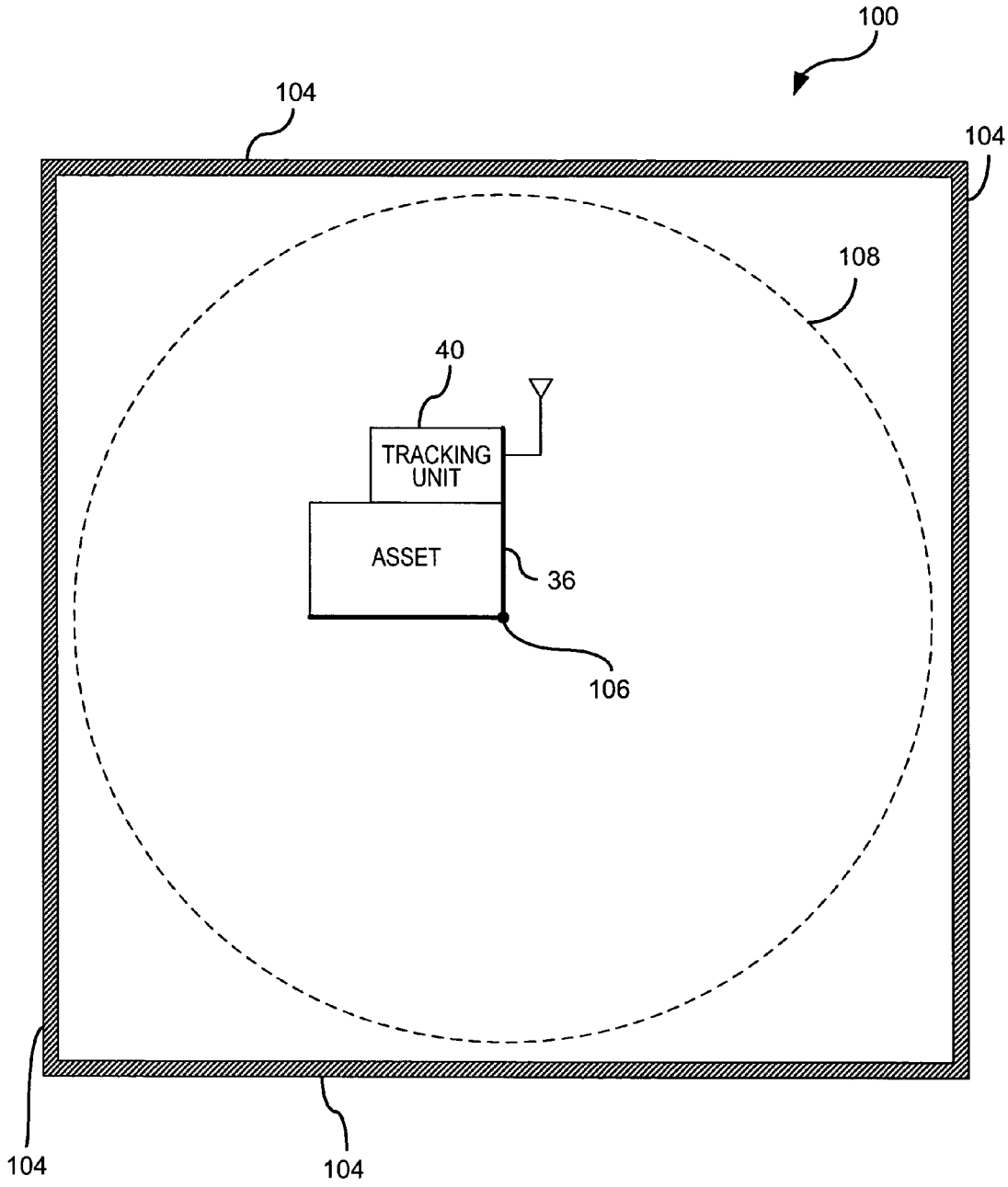
FIGS. 3 through 7 are illustrations of an asset in relation to a site and a geofence boundary for various embodiments.

In one embodiment, the asset tracking unit 40 operates to monitor the location provided by the GPS receiver continuously or near continuously and determines that the asset 36 is located at the site 100 when the location information received from the GPS receiver meets certain established criteria. One such criteria may be that the asset has not moved for a certain period of time. For example, an asset 36 is commonly transported to a site 100 in advance of the asset 36 being used at the site 100. The asset 36, in an embodiment, is a piece of construction equipment that may be transported to a development site a day in advance of when it will begin to be used. In such a case, if the asset tracking unit 40 determines that the asset has been stationary for, for example, six hours, the asset 36 is considered to be at the site 100. As will be understood, the time that the asset 36 is stationary may be selected to be any appropriate time. For example, the owner of the asset 36, or the company responsible for monitoring the asset 36, may have knowledge that the asset 36 is being used within a local metropolitan area, and that any movement of the asset 36 between sites 100 will require only relatively short trips of less than a few hours. Thus, if the asset 36 is stationary for more than one hour it may be determined that the asset 36 is located at a site 100. Alternatively, if the asset 36 is a relatively specialized piece of equipment that is transported over great distances, the fact that the asset 36 is stationary for a such a period may simply indicate that the driver of the delivery vehicle has stopped for a break. In such a case, the time period that the asset 36 is stationary before establishing that the asset 36 is at a site 100 may be longer than any expected breaks of the delivery driver. Once the asset 36 is determined to be at the site 100, the asset tracking unit 40 determines the current location coordinates, and uses these coordinates to establish a geofence. In the example of FIG. 3, the asset 36 has location coordinates defined by the coordinates of point 106. The geofence boundary is then established based on the current location, and is illustrated in FIG. 3 by dashed line 108. The geofence boundary 108, in this embodiment, is set to be a preset radius from point 106. However, in other embodiments the determination of location 106 and the establishment of boundary 108 are performed dynamically. Several such embodiments will be described in more detail below.

Figure 4:
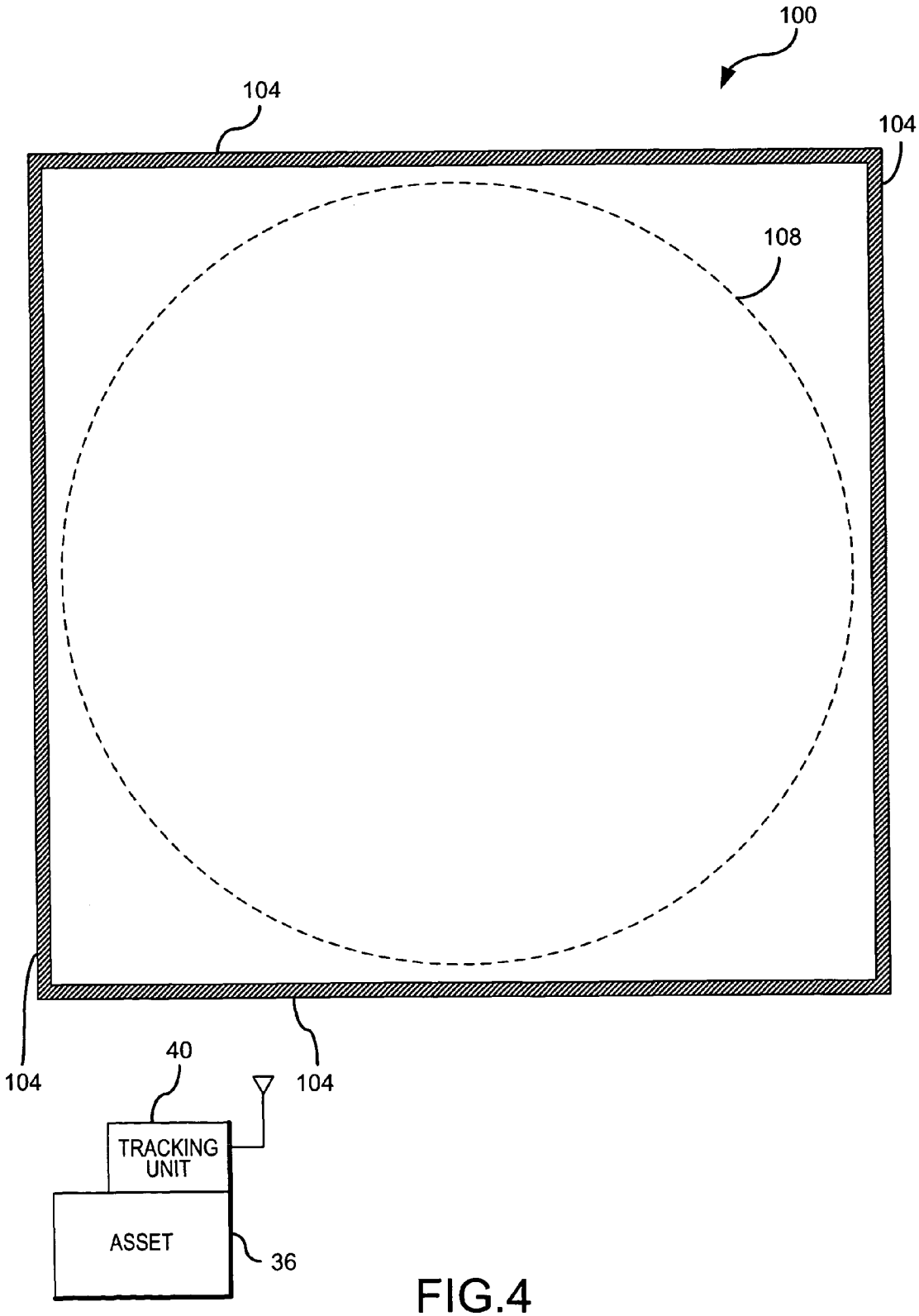
Figure 5:
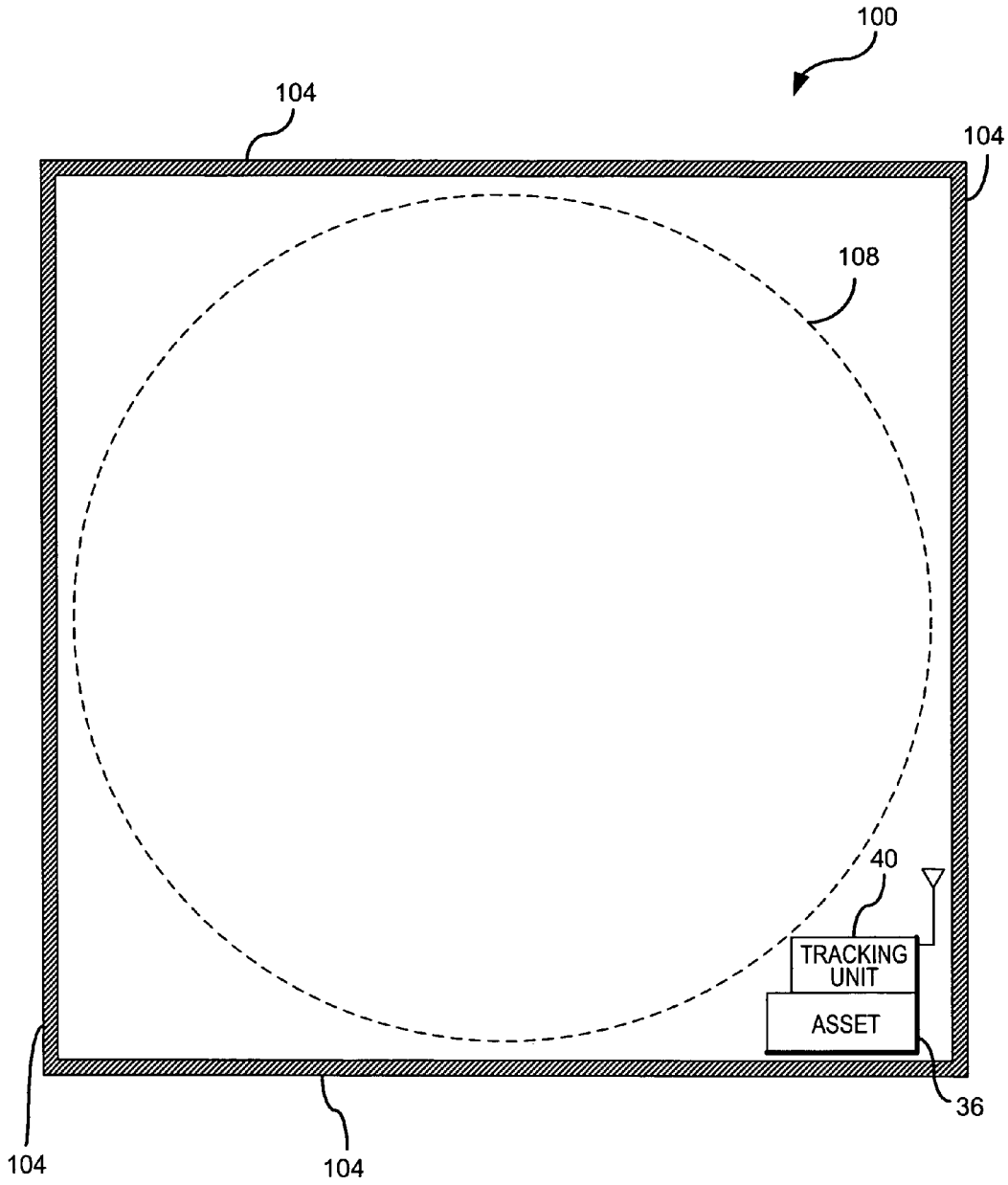
Figure 6:
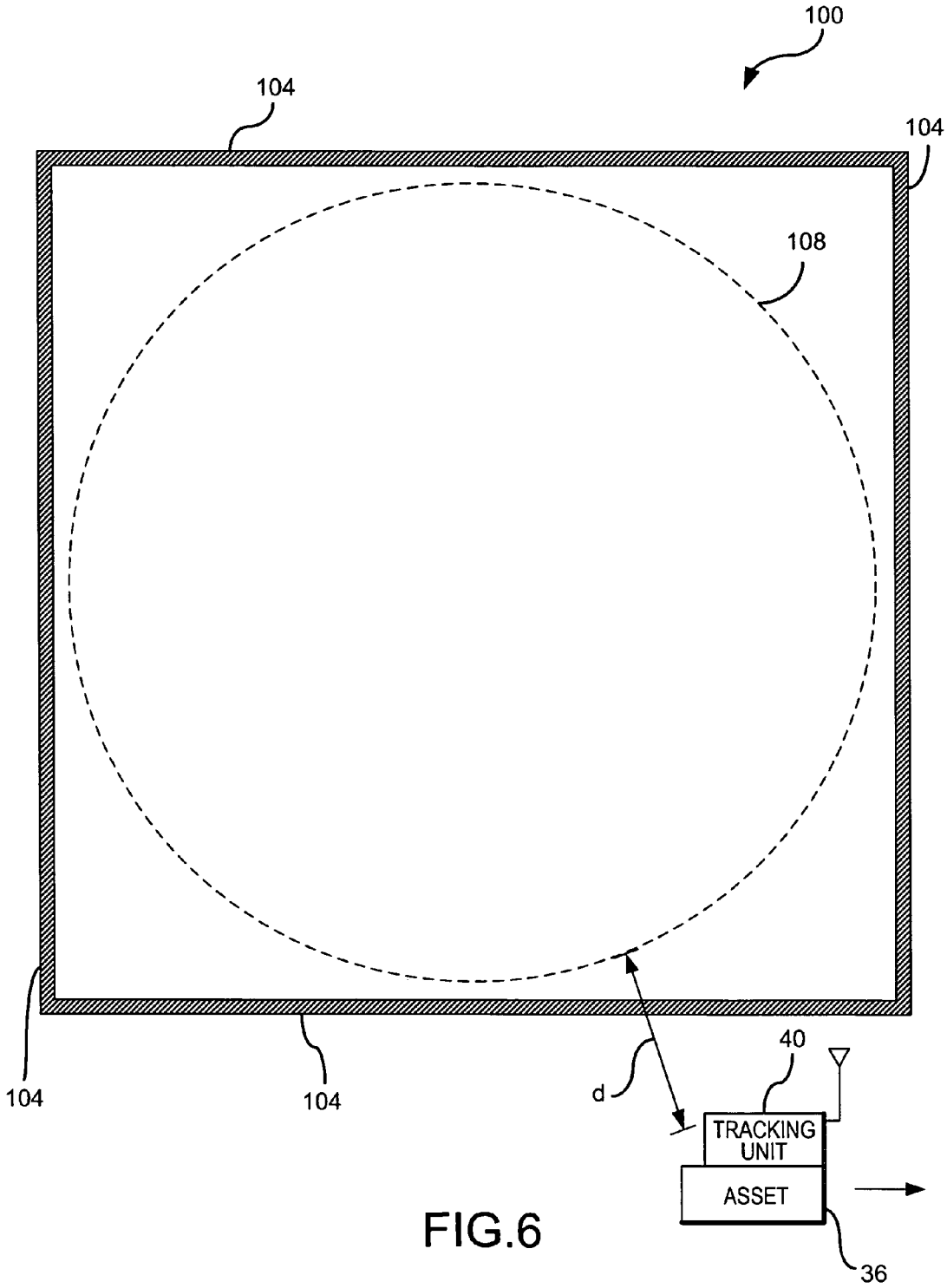
Figure 7:
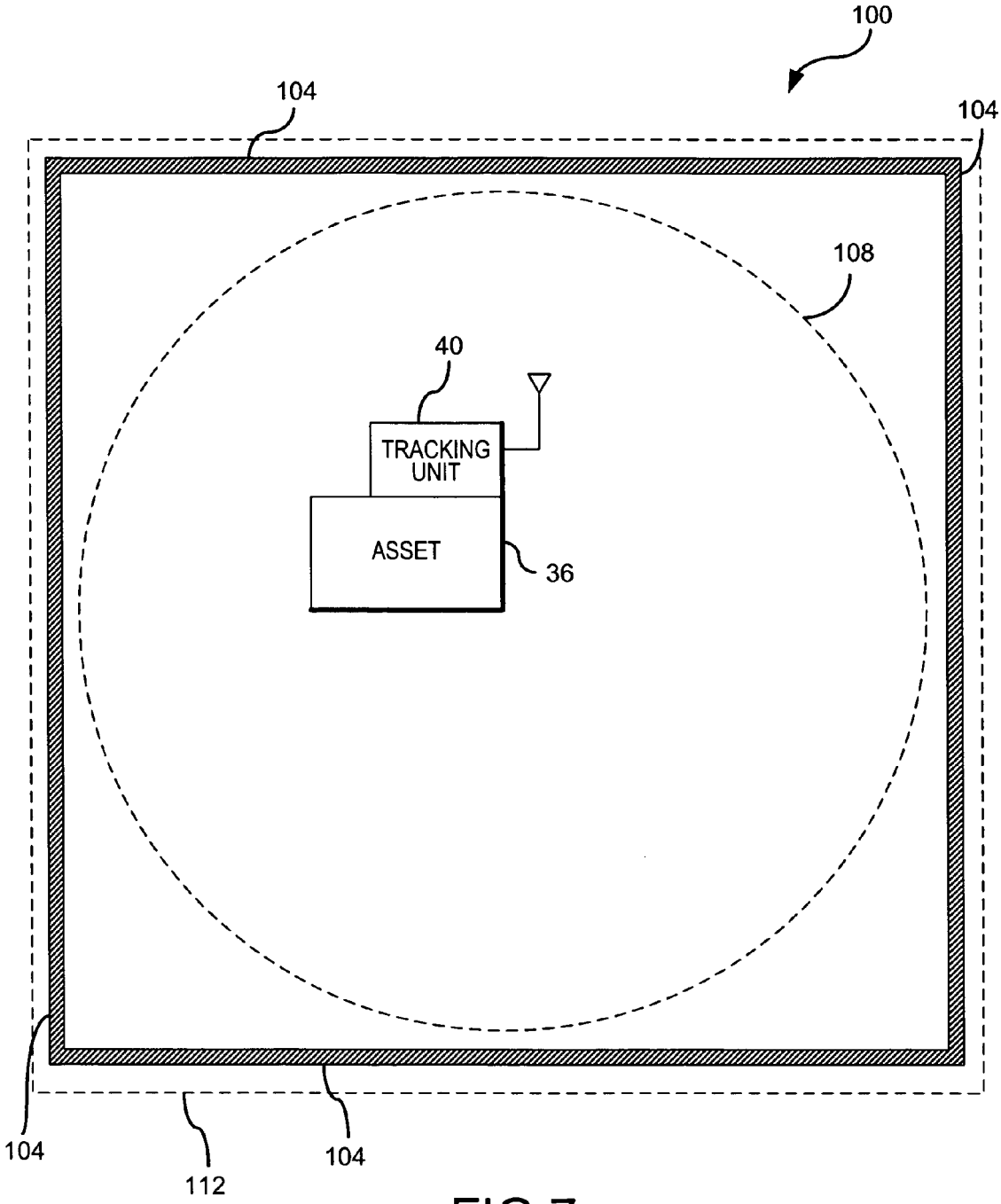

If the asset 36 moves beyond the geofence boundary 108, the asset tracking unit 40 transmits a notification that the asset 36 is no longer located at the site 100. Such a situation is illustrated in FIG. 4. In the illustration of FIG. 4, the asset 36 is located beyond the site boundary 104, and thus the generation of a notification that the asset 36 has left the site is accurate. However, as the geofence boundary 108 of this embodiment was initially determined based on a preset radius of the location of the asset 36 when the asset 36 arrived at the site, there may be locations within the physical site boundary 104 that are outside of the geofence boundary 108. Such a situation is illustrated in FIG. 5. In this case, the notification that the asset has left site 100 is in error. In order to reduce the number of false notifications, one embodiment provides a notification that the geofence is broken when the asset 36 location is outside of boundary 108 and the speed of the asset is above a preset threshold. Such a situation is illustrated in FIG. 6. In such an embodiment, the preset speed threshold is set to be greater than the asset would normally travel at while the asset is at the site 100. In this manner, if the asset 36 is beyond the boundary 108, but traveling at a relatively low speed, it is assumed that the asset 36 has not left the site 100, and no notification is generated. In order to reduce the likelihood that the asset 36 is moved off of the site 100 at a speed below the preset threshold, a predefined distance (d) may also be used to determine if a notification should be sent from asset tracking unit 40. Thus, even if the asset 36 is traveling at low speed, once the asset is beyond a certain distance from boundary 108, it is assumed that the asset 36 has been moved from site 100. In this manner, the asset 36 may be operated outside of boundary 108 without a notification being sent that the geofence has been broken. In this manner, if the preset geofence set by the asset tracking unit 40 does not completely encompass the site 100, the number of notifications that the asset 36 has been moved from the site 100 will be reduced.

The boundary 108 set by asset tracking unit 40 may be selected based on a number of factors. For example, the asset tracking unit 40 may be programmed to set such a boundary 108 based on expected movement of the asset 36. In one embodiment, the asset is a piece of construction equipment, and it is known that the asset typically moved around construction sites that are less than one mile square. In such a case, the asset tracking unit 40 may be set to provide a boundary 108 having a radius of 1.5 miles. In this manner, in the event that the asset 36 is delivered to one corner of the site 100, and the location of this corner is set to be the center of the boundary 108, it is unlikely that the asset 36 will move beyond the boundary 108 while at any point on the site 100.

In a further embodiment, the asset tracking unit 40 may set the default geofence boundary 108, with this boundary being overridden by the server. In such an embodiment, the server may set a new boundary, illustrated by dashed line 112 in FIG. 7. The boundary 108 may initially be set by the asset tracking unit 40 with the boundary 112 later set by the server. In this manner, the asset 36 may be moved to the site 100 with the boundary 108 established, and a notification generated if the asset 36 moves beyond the geofence. For example, when the asset 36 is initially moved to site 100, it may be desired to establish a geofence almost immediately upon the arrival of the asset 36. This geofence may then be modified to more accurately correspond to the actual site boundary 104. In such a manner, the asset 36 may begin operating at the site 100 with a geofence in place, and thus an interested entity will be notified if the asset moved beyond the boundary 108. In one embodiment, the asset 36 is typically delivered one or more days before the asset 36 is to be used and moved around the site 100. In such a case, the asset tracking unit 40 may establish a relatively small boundary 108, thus generating a notification in the event the asset 36 is moved, which may indicate unauthorized use or theft of the asset 36. The modified boundary 112 may then be set when it is expected that the asset 36 will begin use. In such a manner the predetermined, or default, geofence boundary 108 is established relatively quickly upon arrival of the asset 36 at the site 100 and enables the asset 36 to be monitored more closely. In another embodiment, the default boundary 108 is known to be significantly smaller than the actual site boundary 104. In such a case, it is necessary to modify the geofence boundary in order to prevent false notifications of asset movement from being generated.

Figure 8:
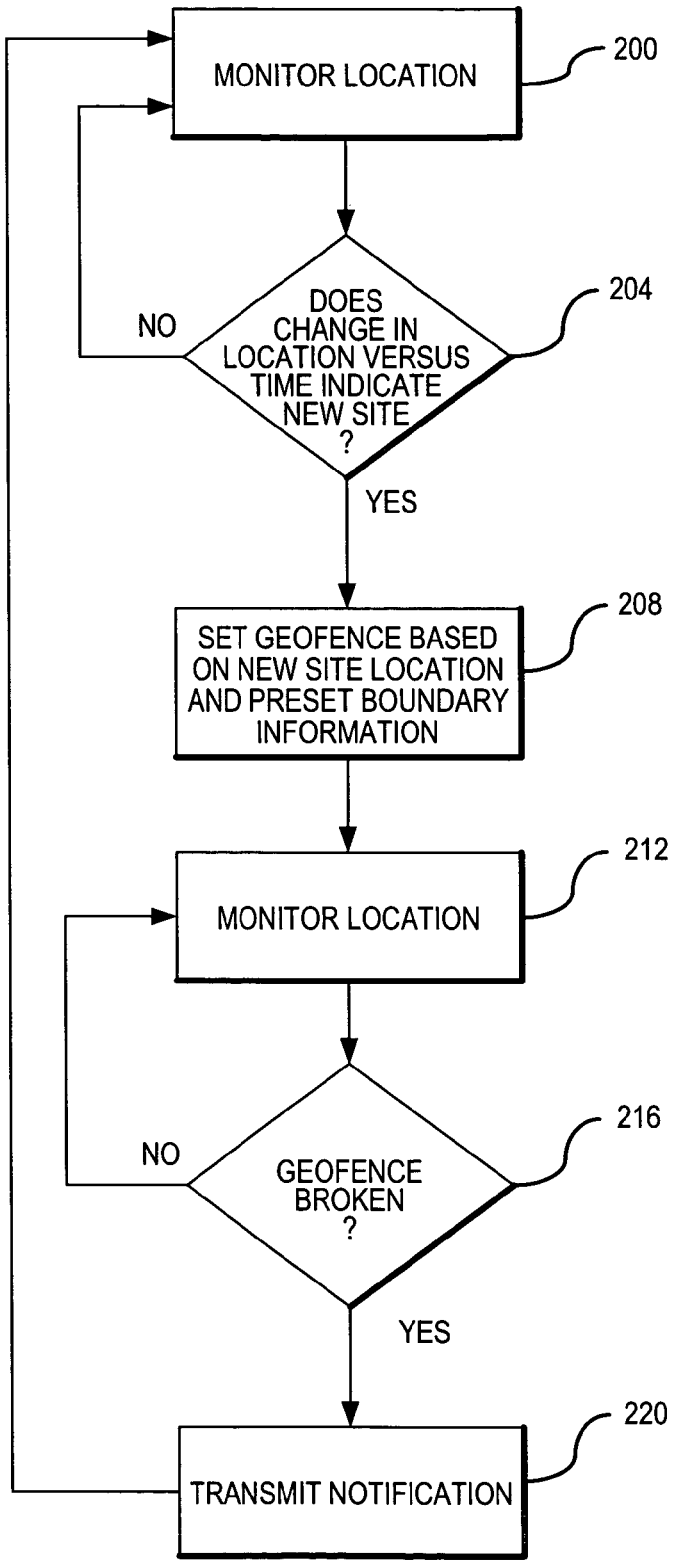
FIG. 8 is a flow chart illustration of the operations of an embodiment of an asset tracking unit.

Referring now to FIG. 8, typical operations performed by an asset tracking unit embodiment associated with an asset are now described. Initially, as indicated at block 200, the asset tracking unit monitors the location of the asset. As mentioned above, the asset tracking unit commonly has a GPS receiver associated therewith that is able to output location information at periodic intervals. As will be understood, these periodic intervals may be nearly continuous, and such a GPS receiver may also output speed information that indicates the speed at which the GPS receiver, and thus the asset, is traveling. At block 204, it is determined by the asset tracking unit if the change in location versus time indicates that the asset has arrived at the new site. As mentioned previously, such a determination may be made on several different factors. For example, if the location of the asset has remained stationary for a preset period of time, this may indicate that the asset is at a site. Similarly, if the location information indicates that the asset has not moved outside of a predefined radius for a predefined period of time, this may indicate that the asset is at a new site. In one example, the asset is a piece of construction equipment that is used on and around a construction site. As is understood, such construction sites are often quite large, and the piece of construction equipment may travel throughout the entire construction site. In such a case, the said tracking unit may monitor the location and determine that the asset has not moved beyond a certain radius, such as one mile, from a calculated center point of the location information received from the GPS receiver. Similarly, the asset tracking unit may monitor both the location and speed at which the asset is traveling, and determine that the asset is at a new site when the location remains within a certain radius of a center or average location for a certain period of time, and if the asset has been moving speeds at or below a preset threshold. For example, continuing with the construction equipment example described above, if the piece of construction equipment, while in use, typically travels at speeds of no greater than 10 miles per hour, the asset tracking unit may determine that the asset is at a new site when the speed of the asset has remained below such a preset threshold and the location of the asset has remained within a certain radius of a calculated center location within the time period.

Referring still to FIG. 8, if at block 204 it is determined that the asset is not at a new site, the operations of blocks 200 and 204 are repeated. If it is determined that the asset is at a new site, the asset tracking unit sets a geofence based on the new site location and preset boundary information, as indicated at block 208. The new site location may be determined in a number of different ways, such as a computed center point of the asset location during the time period in which it was determined that the asset was at a new site, the location of the asset if the asset is stopped or has very little movement for a preset time period, or a location that has been previously stored in the memory of the asset tracking unit, such a location being the location of the next site or job for the asset. The preset boundary information may be selected based upon the expected movement of the asset, or any appropriate criteria. For example, as described above, if the asset is a piece of construction equipment and the site at which the asset operates is generally one mile in diameter, the preset boundary information may be selected to be at a radius of one-half mile from the center point of the location information. Such boundary information may also be determined based upon the movement of the asset during the period in which it is determined that the asset is at a new site. In such an embodiment, a center point location is calculated based on the different locations during the time period used to establish that the asset is at a new site. The locations farthest from the center point during this time period are used to determine the geofence boundary, such as by setting the boundary to be at a radius of the farthest point from the calculated center point. At block 212, the asset tracking unit monitors the location of the asset, and at block 216 it is determined if the geofence is broken. If the geofence is not broken, the asset tracking unit continues to monitor the location of the asset as noted at block 212. If the geofence is broken at block 216, the asset tracking unit transmits a notification indicating that the geofence has been broken as indicated at block 220. The determination that the geofence has been broken may also include determining that the asset is moving at a speed greater than a preset threshold and is outside the boundary, similarly as described above. Following the transmission of the notification, the operations of block 200 are repeated.

Figure 9:
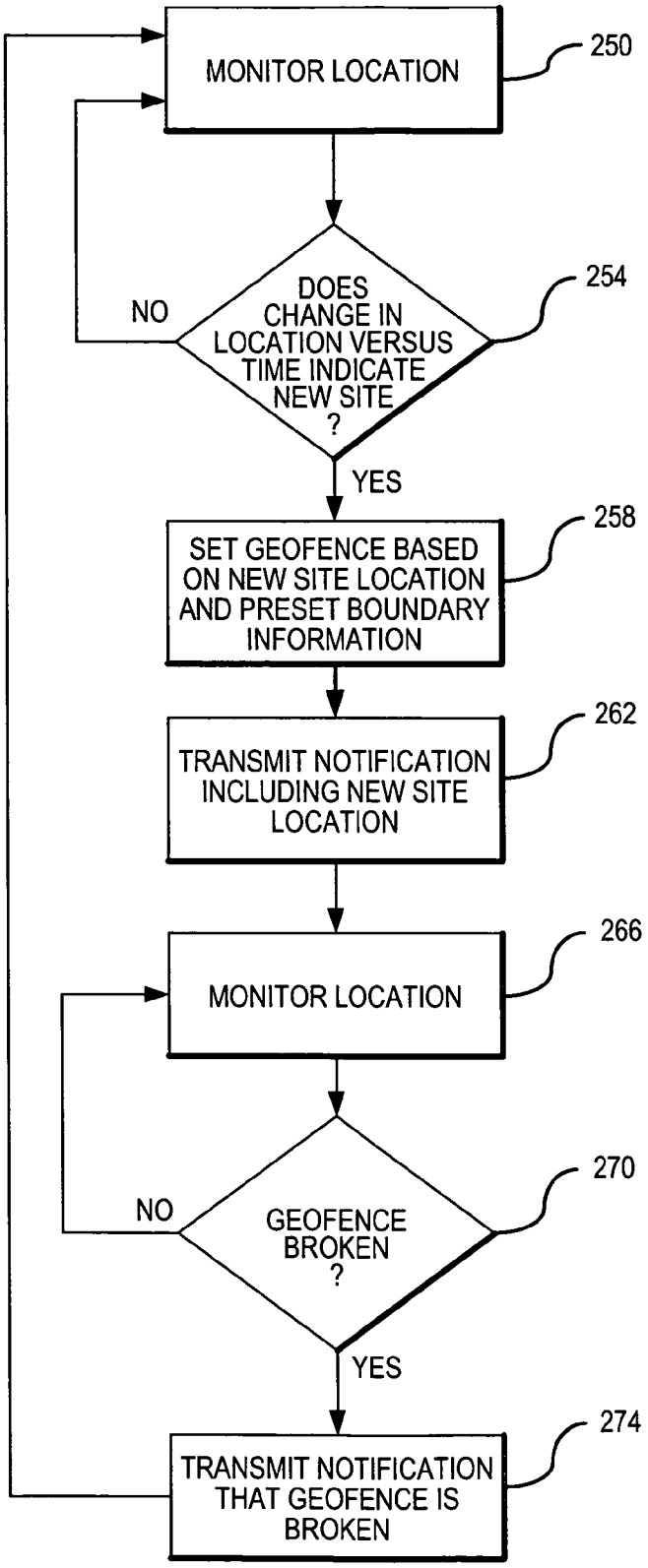
FIG. 9 is a flow chart illustration of the operations of another embodiment of an asset tracking unit.

Referring now to FIG. 9, the asset tracking unit operations of another embodiment are now described. In this embodiment, the asset tracking unit monitors the location of the asset as noted at block 250. At block 254, it is determined if the change in location versus time indicates that the asset is at a new site. If the asset is not at a new site, the operations of blocks 250 and 254 are repeated. If the asset is at a new site, a geofence is set based upon the new site location and preset boundary information, as noted at block 258. The determinations of a new site, and the new site location and boundary information, are done in a similar manner as described above. At block 262, the asset tracking unit transmits a notification including the new site location. Such a notification may be sent to a central server or central dispatch to notify personnel at the central dispatch that the asset has arrived at the new site.

Such a notification may be used by dispatch personnel to verify that the asset has arrived at the new site at a scheduled time, for example. At block 266, the asset tracking unit monitors the location of the asset, and at block 270 it is determined if the geofence is broken. If the geofence is not broken, the asset tracking unit repeats the operations described with respect to blocks 266 and 270. If the geofence is broken, the asset tracking unit generates and transmits a notification that the geofence is broken as noted at block 274. The operation as described with respect to block 250 is then repeated.

Figure 10:
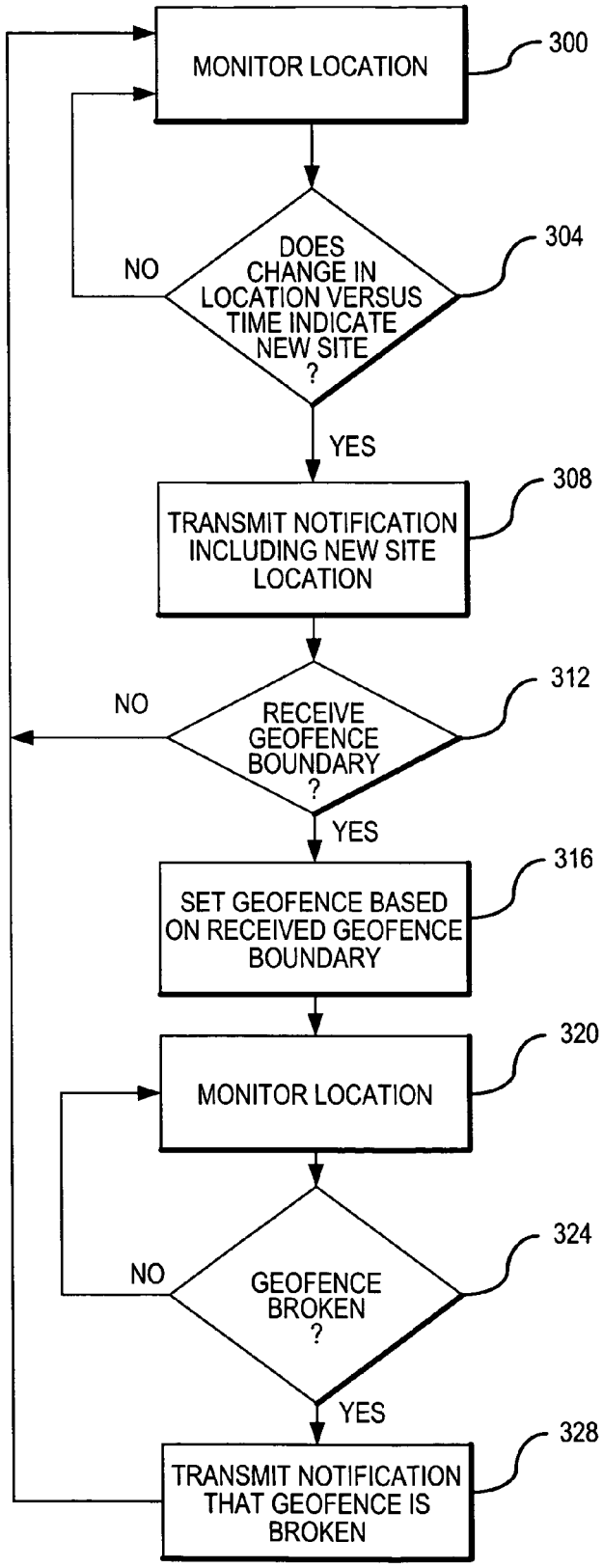
FIG. 10 is a flow chart illustration of the operations of another embodiment of an asset tracking unit.

Referring now to FIG. 10, the operations of an asset tracking unit of yet another embodiment are described. In this embodiment, the asset tracking unit monitors the location of the asset as noted at block 300. At block 304, it is determined if the change in location versus time indicates that the asset is at a new site. If the asset is not at a new site, the operations with respect to blocks 300 and 304 are repeated. If the asset is at a new site, the asset tracking unit transmits a notification including the new site location, as noted at block 308. The determination that the asset is at a new site, and the location of such a new site may be determined in a similar manner as described above. At block 312, it is determined if the asset tracking unit has received a geofence boundary. If the asset has not received a geofence boundary, the operations described with respect to block 300 are repeated. If the asset does receive a geofence boundary, the asset sets the geofence based on the received geofence boundary as noted at block 316. In such a manner, the determination of the geofence boundary is not performed by the asset tracking unit, but rather is set by a central dispatch or central server based upon the notification received from the asset tracking unit. In such a manner, the geofence may be set based upon the particular site that the asset has been moved to and expected movement of the asset in and around such a site. As is understood, the site size and expected movement may vary significantly among asset types and at different sites, and in such an embodiment, the geofence boundary is simply transmitted from the central server or central dispatch based upon such unique information. At block 320, the asset tracking unit monitors the location of the asset and at block 324, it is determined if the geofence is broken. If the geofence is not broken, the operations of block 320 and 324 are continued. In the event that the geofence is broken at block 324, the asset tracking unit transmits a notification that the geofence is broken as noted at block 328. The operations described with respect to block 300 are then repeated.

Figure 11:
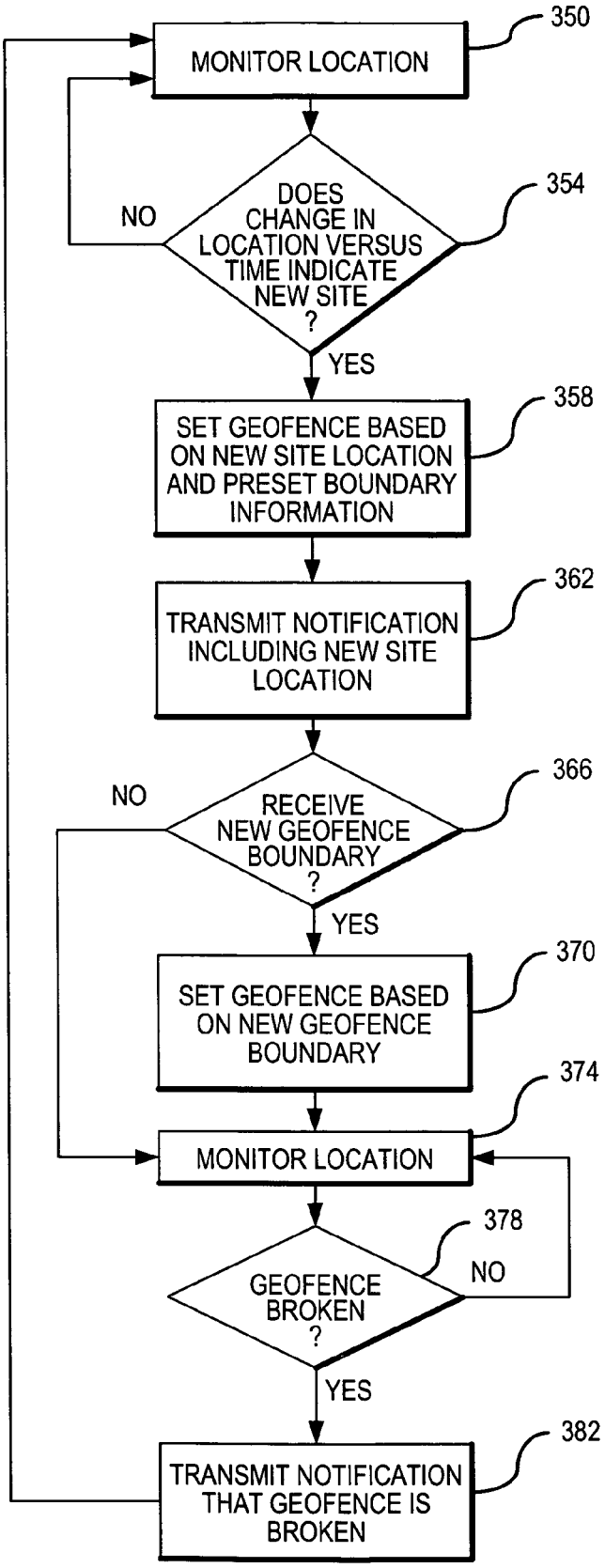
FIG. 11 is a flow chart illustration of the operations of still another embodiment of an asset tracking unit.

Referring now to FIG. 11, the operations of an asset tracking unit of a still further embodiment are described. In this embodiment, the asset tracking unit monitors the location of the asset as indicated at block 350. At block 354, it is determined if the change in location versus time indicates that the asset is at a new site. If the asset is not at a new site, the operations of blocks 350 and 354 are continued. If the asset is at a new site, the asset tracking unit sets a geofence based upon the new site location and preset boundary information, as indicated at block 358. The determination of whether the asset is at a new site, the site location, and the boundary information are performed in similar manners as described above. At block 362, the asset tracking unit transmits a notification including the new site location. At block 366, it is determined if a new geofence boundary has been received. If such a new geofence boundary has been received, the asset tracking unit, at block 370, sets the geofence based upon the new geofence boundary. In such a manner, when an asset initially arrives at a new location, a default geofence is established for the asset, and the location of the asset is transmitted to a central server or central dispatch. In the event that the central server or central dispatch determines that the default geofence boundary is not appropriate for the particular site at which the asset is located, a new geofence may be transmitted to the asset tracking unit in order to accommodate for the particular site variance. If a new geofence boundary is not received at block 366, or after the geofence is set based upon a new received geofence boundary, the asset tracking unit monitors the location of the asset as indicated at block 374. At block 378, it is determined if the geofence is broken. If the geofence is not broken, the operations of block 374 and 378 are continued. In the event that the geofence is broken, the asset tracking unit transmits a notification that the geofence is broken, as noted at block 382, and the operations as described with respect to block 350 are repeated.

It should be noted that, while the embodiments of FIGS. 8-11 illustrate the asset tracking unit monitoring asset location and setting geofence boundaries based on established criteria, the server may also perform such tasks. In these embodiments, the asset tracking unit periodically transmits notifications of the asset location to a server, with the server then making the determinations of when the asset is considered to be at a site, setting of the geofence boundaries, determining if the boundaries have been broken, and the transmittal of appropriate notifications. Furthermore, some of these tasks may be performed by the server, and others by the asset tracking unit. Such embodiments are considered to be well within the abilities of one skilled in the art.

The invention claimed is:

1. A method comprising:

with an asset tracking unit physically located with an asset:

at least estimating a location and a rate of movement of the asset;

dynamically determining that the asset is located at a site based, at least in part, on passage of a period of time during which the rate of movement of the asset has remained at or below a preset threshold; and in response to determining that the asset is located at the site, establishing a geofence for the asset with regard to the site, based, at least in part, on movement of the asset at the site during the period of time;

wherein subsequently determining whether the asset is outside of the geofence comprises:

determining that a subsequent at least estimated location of the asset is outside of the geofence; and determining that a subsequent at least estimated rate of movement of the asset exceeds a threshold rate of movement.

2. The method as claimed in claim 1, further comprising:

with the asset tracking unit:

subsequently determining whether the asset is outside of the geofence; and in response to a determination that the asset is outside of the geofence, transmitting a notification that the asset is outside of the geofence.

3. The method as claimed in claim 1, wherein establishing the geofence for the asset with regard to the site comprises:

setting the geofence for the asset with regard to the site based, at least in part, on an expected movement of the asset while the asset is located at the site.

4. The method as claimed in claim 1, wherein at least a portion of a geofence boundary associated with the site is based, at least in part, on a predetermined or default distance value.

5. The method as claimed in claim 4, further comprising:

with the asset tracking unit:

transmitting a notification to at least one remote device that the geofence has been established;

receiving a response to the notification indicating a revised boundary for the geofence; and re-setting the geofence based, at least in part, on the revised boundary.

6. The method as claimed in claim 1, further comprising: with the asset tracking unit:

transmitting a notification to at least one remote device indicating that the asset is located at the site;

receiving a response to the notification indicating at least a first geofence boundary associated with the site; and re-setting the geofence based, at least in part, on the first geofence boundary.

7. The method as claimed in claim 1, wherein dynamically determining that the asset is located at the site is further based, at least in part, on a determination that the asset remains remained within a threshold radius of a location for at least a threshold the period of time.

8. An apparatus physically co-located with an asset, the apparatus comprising:

a location sensor to at least estimate a location and a rate of movement of the asset; and a controller to:

dynamically determine that the asset is located at a site based, at least in part, on passage of a period of time during which the rate of movement of the asset has remained at or below a preset threshold, and in response to a determination that the asset is located at the site, establish a geofence for the asset with regard to the site, based, at least in part, on movement of the asset at the site during the period of time;

wherein subsequently determining whether the asset is outside of the geofence comprises:

determining that a subsequent at least estimated location of the asset is outside of the geofence; and determining that a subsequent at least estimated rate of movement of the asset exceeds a threshold rate of movement.

9. The apparatus, as claimed in claim 8, further comprising:

a wireless communication portion to send/receive wireless communication signals, and the controller further to send a notification to at least one remote device using the wireless communication portion, the notification identifying that the asset is located at the site.

10. The apparatus, as claimed in claim 9, the wireless communication portion further to receive a response to the notification, the response identifying a revised geofence boundary, and the controller to further re-establish said geofence based, at least in part, on the revised geofence boundary.

11. The apparatus, as claimed in claim 8, further comprising:

a wireless communication portion to send/receive wireless communication signals, and the controller further to determine whether a subsequent location of the asset is outside of the geofence and in response to a determination that the asset is outside of the geofence transmit a corresponding notification to at least one remote device using the wireless communication portion.

12. The apparatus, as claimed in claim 8, the controller to further dynamically determine that the asset is located at the site based further, a least in part, on a determination that the asset remained within a threshold radius of a location for at least the period of time.

13. An article comprising:

a non-transitory tangible data storage medium having stored thereon instructions executable by a programmable device to:

monitor at least an estimated location and a rate of movement of an asset;

dynamically determine that the asset is located at a site based, at least in part, on passage of a period of time during which the rate of movement of the asset has remained at or below a preset threshold; and in response to a determination that the asset is located at the site, establish a geofence for the asset with regard to the site, based, at least in part, on movement of the asset at the site during the period of time, and wherein the programmable device is physically co-located with the asset;

wherein subsequently determining whether the asset is outside of the geofence comprises:

determining that a subsequent at least estimated location of the asset is outside of the geofence; and determining that a subsequent at least estimated rate of movement of the asset exceeds a threshold rate of movement.

14. The article, as claimed in claim 13, further comprising instructions executable by the programmable device to:

subsequently determine whether the asset is outside of the geofence; and in response to a determination that the asset is outside of the geofence, initiate transmission of a notification that the asset is outside of the geofence.

15. The article, as claimed in claim 14, further comprising instructions executable by the programmable device to:

determine that a subsequently at least estimated location of the asset is outside of the geofence; or determine that a subsequently at least estimated rate of movement of the asset exceeds a threshold rate of movement.

16. The article, as claimed in claim 13, wherein the geofence is established based, at least in part, on an expected movement of the asset while the asset is located at the site.

17. The article, as claimed in claim 13, further comprising instructions executable by the programmable device to:

initiate transmission of a notification that the geofence has been set;

receive a response to the notification indicating a revised boundary for the geofence; and re-set the geofence based, at least in part, on the revised boundary.

18. The method as claimed in claim 1, wherein the rate of movement comprises a determined speed of the asset.

19. The apparatus as claimed in claim 8, wherein the rate of movement comprises a determined speed of the asset.

20. An apparatus physically co-located with an asset, the apparatus comprising:

means for determining one or more electronic signals representing at least an estimated location and a rate of movement of an asset;

means for dynamically determining one or more electronic signals representing that the asset is located at a site based, at least in part, on passage of a period of time during which the one or more electronic signals representing the rate of movement of the asset has remained at or below a preset threshold;

means for establishing a geofence for the asset with regard to the site in response to a determination that the asset is located at the site, based, at least in part, on movement of the asset at the site during the period of time; and means for storing at least the one or more electronic signals representing the geofence;

wherein subsequently determining whether the asset is outside of the geofence comprises:

determining that a subsequent at least estimated location of the asset is outside of the geofence; and determining that a subsequent at least estimated rate of movement of the asset exceeds a threshold rate of movement.

21. The apparatus as claimed in claim 20, further comprising:

means for determining one or more electronic signals representing whether the asset is subsequently located outside of the geofence; and means for transmitting one or more electronic signals representing a notification message, in response to a determination that the asset is subsequently location outside of the geofence, the notification message identifying that the asset is outside of the geofence.

22. The apparatus as claimed in claim 20, further comprising:

means for transmitting one or more electronic signals representing a notification message, the notification message identifying that the geofence has been established;

means for receiving one or more electronic signals representing a response message to the notification message, the response message indicating a revised boundary for the geofence; and means for re-setting the geofence based, at least in part, on the revised boundary.

23. The apparatus as claimed in claim 20, further comprising:

means for transmitting one or more electronic signals representing a notification message, the notification message identifying that the asset is located at the site;

means for receiving one or more electronic signals representing a response message to the notification message, the response message indicating at least a first geofence boundary associated with the site; and means for re-setting the geofence based, at least in part, on the first geofence boundary.

24. The apparatus as claimed in claim 20, wherein the rate of movement comprises one or more electronic signals representing a determined speed of the asset.

25. The article as claimed in claim 13, further comprising instructions executable by the programmable device to:

dynamically determine that the asset is located at the site further based, at least in part, on a determination that the asset remained within a threshold radius of a location for at least the period of time.

26. The apparatus as claimed in claim 20, further comprising:

means for determining whether the asset remained within a threshold radius of a location for at least the period of time; and wherein the means for dynamically determining one or more electronic signals representing that the asset is located at the site is further based, at least in part, on a determination that the asset remained within the threshold radius of the location for at least the period of time.

* * * * *